United States Patent [19]

Wallis

[11] 3,998,600

[45] Dec. 21, 1976

[54] HEAT EXCHANGER STRIP AND METHOD AND APPARATUS FOR FORMING SAME

[76] Inventor: Bernard J. Wallis, 25200 Trowbridge Ave., Dearborn, Mich. 48124

[22] Filed: June 16, 1975

[21] Appl. No.: 587,084

[52] U.S. Cl. ..... 29/180 SS; 72/187; 72/196; 165/152

[51] Int. Cl.[2] ..... F28D 1/02; B21D 13/10

[58] Field of Search ..... 72/187, 196; 165/152; 29/180 SS, 193.5

[56] References Cited

UNITED STATES PATENTS

| | | | |
|---|---|---|---|
| 1,233,081 | 7/1917 | McFarland | 165/152 |
| 1,450,351 | 4/1932 | Beran | 72/196 |
| 1,916,120 | 6/1933 | Bixby | 72/187 |
| 2,329,789 | 9/1943 | Schank et al. | 72/187 |
| 2,684,707 | 7/1954 | Getz | 72/187 |

FOREIGN PATENTS OR APPLICATIONS

| | | | |
|---|---|---|---|
| 954,066 | 4/1964 | United Kingdom | 165/152 |

*Primary Examiner*—Lowell A. Larson
*Attorney, Agent, or Firm*—Barnes, Kisselle, Raisch & Choate

[57] ABSTRACT

A method and apparatus for rolling metal ribbon stock into convoluted fin strip for use in heat exchangers is disclosed. The passageways defined by adjacent convolutions may be of zig-zag shape in a direction transversely of the strip by reason of the fact that the form rolls are designed such that the return bent portions connecting successive convolutions are initially formed as two symmetrical half sections separated by a sharp bend line extending transversely along the centerline thereof. After the strip emerges from between the form rolls it is gathered or compressed lengthwise in a conventional manner so that further bending of the convolutions is localized along said sharp straight bend lines.

24 Claims, 27 Drawing Figures

HEAT EXCHANGER STRIP AND METHOD AND APPARATUS FOR FORMING SAME

This invention relates to a heat exchanger strip and more particularly to a strip having transversely extending zig-zag convolutions or fins along the length thereof, of the type commonly used in heat exchangers for such devices as vehicle radiators, air conditioning units, etc.

In the manufacture of such finned strips where the crests of the adjacent convolutions are defined by a straight bend line or a radius which extends transversely of the strip in a straight path, it is usual practice to form such convoluted strips between pairs of form rolls having intermeshing teeth around their outer peripheries which roll form flat strip stock into generally expanded convoluted contour. After the convolutions are initially formed in this manner, the zig-zag strip is gathered or compressed lengthwise to form a more acute bend at the crests of the successive convolutions and thus bring the convolutions closer together to define fluid passageways of desired shape and size extending transversely through the strip.

To increase the heat exchange efficiency of such convoluted strips, each of the fins defining the opposite sides of successive convolutions are frequently lanced between the form rolls to form louvres in the fins and thus produce a more turbulent flow of heat exchange fluid, such as air, through the transversely extending passageways defined by the successive convolutions. However it is sometimes desired to increase the heat transfer efficiency of such fins, not by forming louvres therein, but rather by forming the successive convolutions so that they are corrugated in a direction longitudinally of the strip. The fluid passageways thus extend transversely of the strip in a zig-zag path. When the strip is so formed, the crests of the convolutions do not extend as a straight line across the strip. As a consequence it has been the practice heretofore to form such corrugated convolutions by a stamping process rather than between form rolls. Such a stamping process normally requires a complete reciprocating stroke of the press for each convolution formed. Thus the forming of such corrugated convolutions by stamping is both time consuming and relatively costly.

The present invention has for its primary object the provision for a unique configuration of a finned heat exchanger strip capable of being roll formed and wherein successive convolutions are corrugated in directions both longitudinally and transversely of the strip.

A further object of the invention resides in a method of roll forming finned heat exchanger strips in a manner such that the successive fins or convolutions are of zig-zag shape in directions both longitudinally and transversely of the strip.

Another object of the invention resides in the provision of a pair of form rolls of such shape and design to enable the formation of the convolutions of a heat exchanger strip which are corrugated to define tortuous or sinuous passageways extending transversely through the strip.

More specifically, the present invention is characterized by a finned heat exchanger strip wherein the successive fins or convolutions are formed with a plurality of transversely spaced, vertically extending corrugations and the root of each vertical corrugation on one convolution is transversely aligned with the crest of the next successive vertical corrugation on the adjacent convolution. Even though the transverse passageways defined by the corrugations are a zig-zag shape, the return bends at the upper and lower crests of the fins can be formed by the rolls and bent along straight bend lines to final desired shape of the fins. This configuration of the convoluted strip requires the use of opposed form rolls of like configuration with intermeshing teeth of a particular design. Each form roll is divided axially into generally two sets of tooth sections which are alternately arranged. The leading faces of one set of tooth sections are convex in an axial direction and the leading faces of the other set of tooth sections are concave in an axial direction. The trailing faces of the two sets of tooth sections are of reverse configuration. The convex tooth sections on one roll are designed to mesh with the concave tooth sections on the other roll so that in effect the strip is corrugated both transversely and longitudinally. The form rolls are further characterized in that the crests of the axially aligned tooth sections of convex shape all lie in an axially extending plane at both the radially inner and radially outer ends of the teeth. At their radially inner ends, the axially adjacent teeth are formed with axially extending shoulders which define a straight axially extending line tangent to the surfaces of the radially inner ends of the convex teeth and about which line the metal strip is formed and bent as the radially outer ends or crests of the teeth on one roll mesh with the radially inner ends or roots of the teeth on the other roll.

Other objects and features of the present invention will become apparent from the following description and drawings in which.

Figure 14:
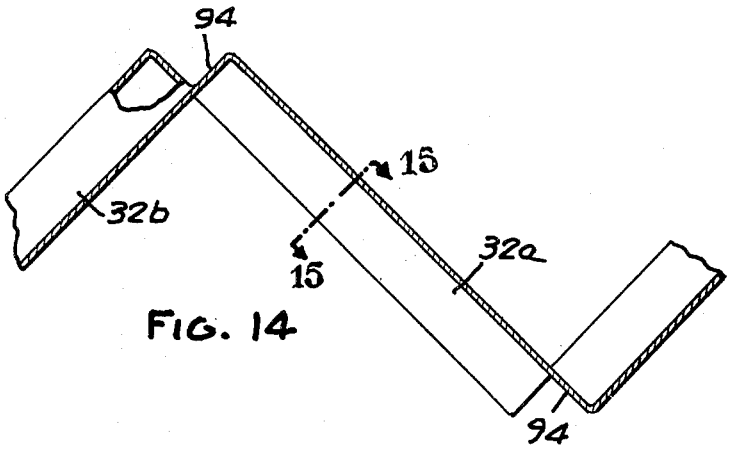
FIG. 14 is a fragmentary sectional view of a modified form of finned strip according to the present invention as it emerges from between the form rolls.

14 and as viewed generally along the line 15—15 in FIG. 14.

Figure 15:
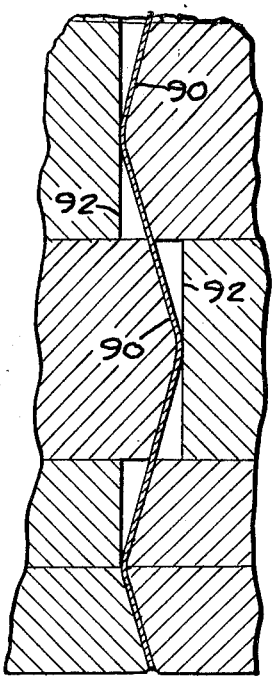
FIG. 15 is a fragmentary sectional view of the form rolls employed for forming the strip illustrated in FIG.
Figure 16:
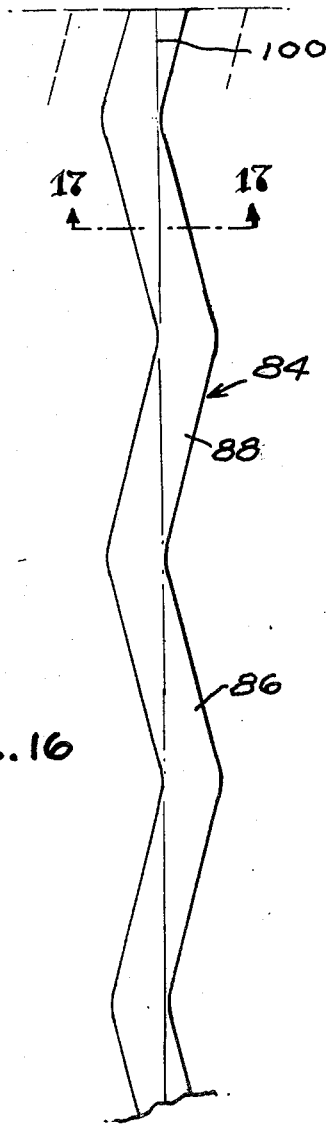

FIG. 16 is a fragmentary plan view of one set of convolutions formed with the rolls shown in FIG. 15.

Figure 17:
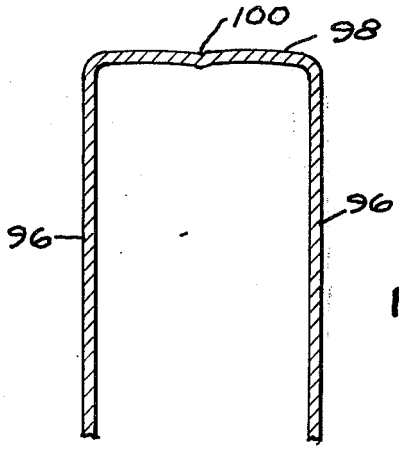

FIG. 17 is a fragmentary sectional view along line 17—17 in FIG. 16.

Figure 18:
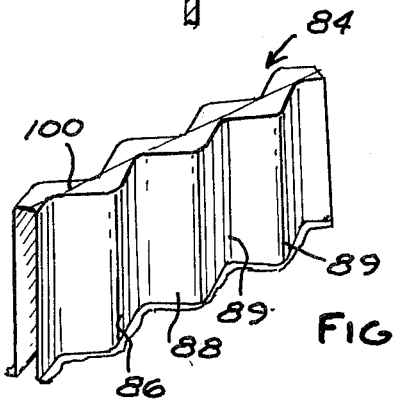

FIG. 18 is a perspective view of the set of convolutions shown in FIG. 16.

Figure 19:
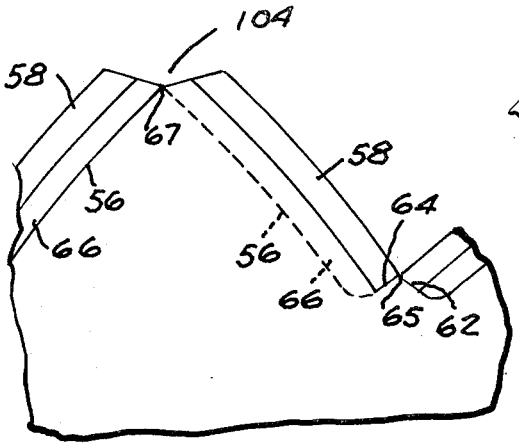

FIG. 19 is a fragmentary side elevational view of another modified form of form roll according to the present invention.

Figure 20:
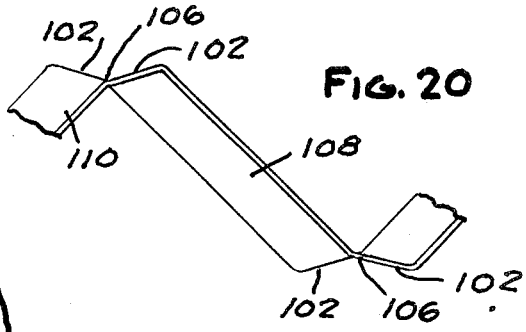

FIG. 20 is a fragmentary view illustrating the configuration of the strip produced by a pair of form rolls of the type illustrated in FIG. 19.

Figure 21:
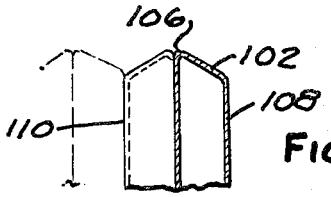

FIG. 21 is a fragmentary vertical sectional view of the finished form of strip shown in FIG. 20.

Figure 22:
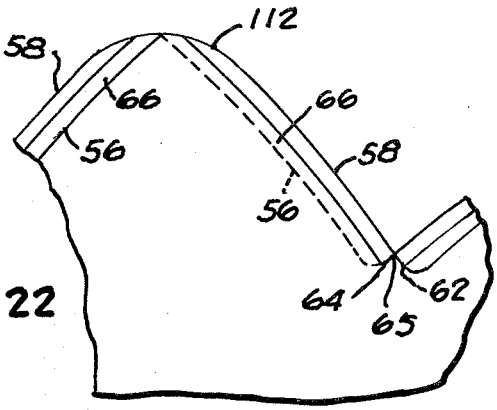

FIG. 22 is a fragmentary side elevational view of another embodiment of form roll according to the present invention.

Figure 23:
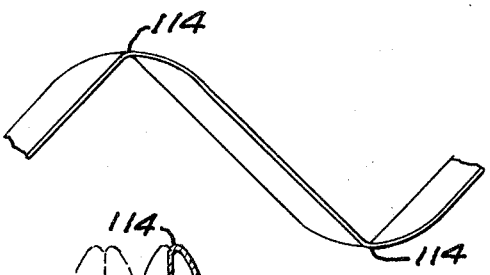

FIG. 23 is a fragmentary view showing the configuration imparted to the strip by a pair of form rolls of the type shown in FIG. 22.

Figure 24:
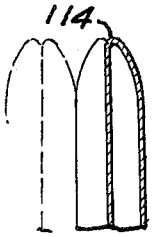

FIG. 24 is a fragmentary vertical sectional view of the finished form of strip shown in FIG. 23.

Figure 25:
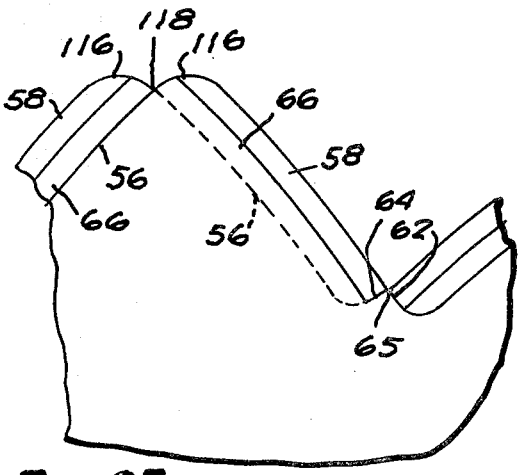

FIG. 25 is a fragmentary side elevational view of another modification of form roll according to the present invention.

Figure 26:
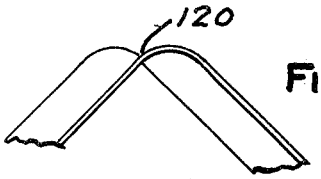

FIG. 26 is a fragmentary view showing the configuration imparted to the strip by a pair of form rolls of the type illustrated in FIG. 25.

Figure 27:
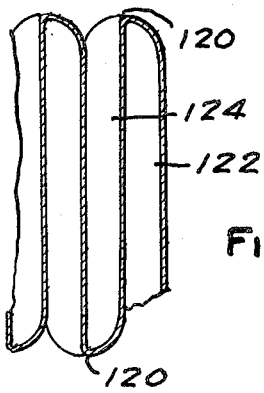

FIG. 27 is a fragmentary vertical sectional view showing the finished form of strip shown in FIG. 26.

Figures 1, 2, 3, 4, 5, 6, 7:
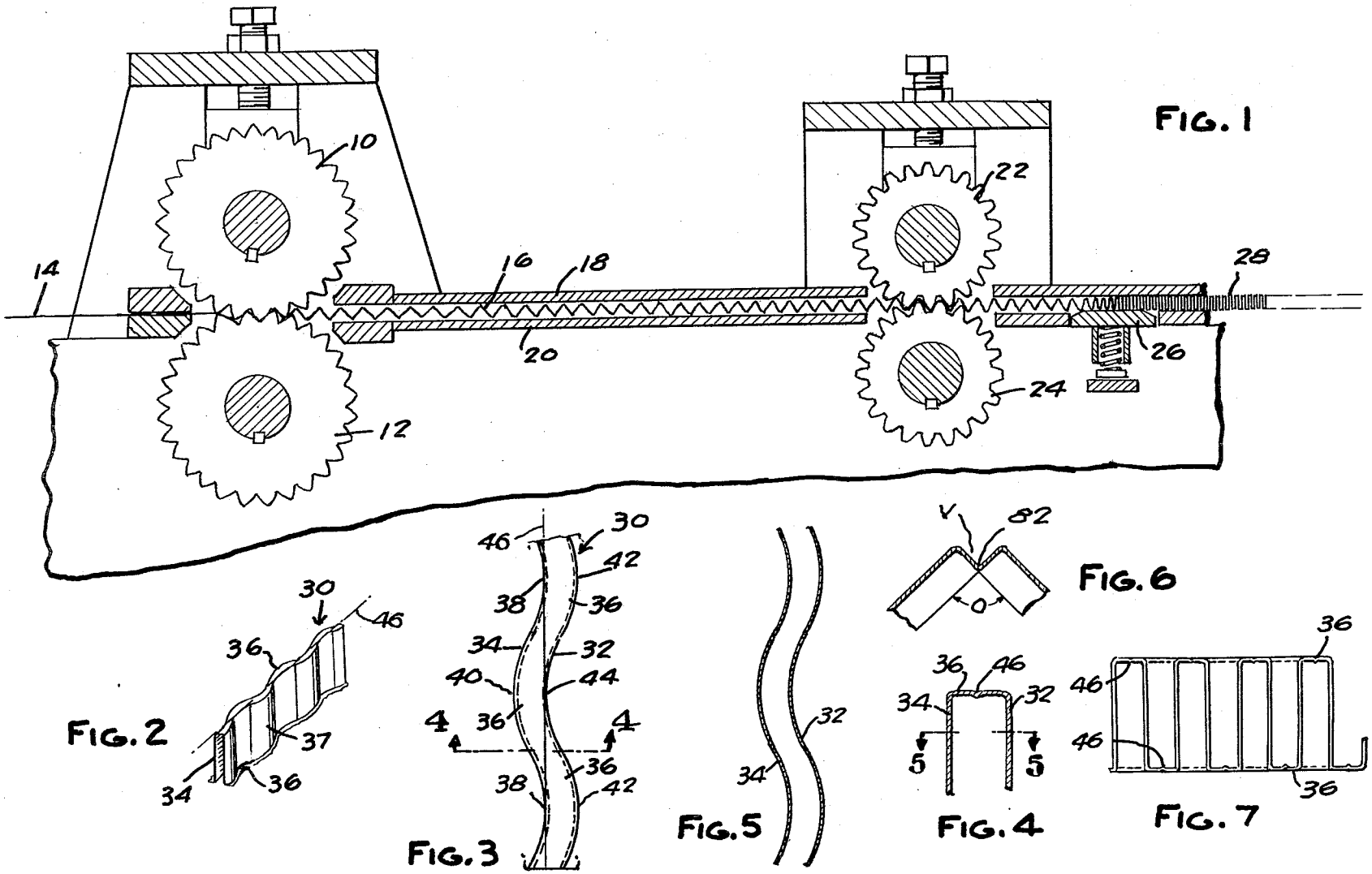
FIG. 1 is a longitudinal sectional view, somewhat diagrammatic, of an apparatus for rolling a heat exchanger corrugated strip according to the present invention.
FIG. 2 is a fragmentary perspective view of a pair of adjacent fins of a corrugated strip according to the present invention.
FIG. 3 is a fragmentary plan view on an enlarged scale of the strip section shown in FIG. 2.
FIG. 4 is a fragmentary sectional view on a further enlarged scale along the line 4—4 in FIG. 3.
FIG. 5 is a fragmentary sectional view along the line 5—5 in FIG. 4.
FIG. 6 is a fragmentary sectional view showing the configuration of the strip as it emerges from between the form rolls.
FIG. 7 is an end view of a portion of the finned strip in its final form.

Referring to FIG. 1, there is illustrated a portion of a generally conventional fin rolling machine which includes a pair of form rolls 10, 12 mounted on the frame of the machine in intermeshing relation as illustrated. Sheet metal ribbon stock 14 is fed from a pair of feed rollers, not illustrated, between the form rolls 10, 12 so as to form corrugations therein, the strip emerging from the form rolls being illustrated at 16. As the corrugated strip 16 emerges from between form rolls 10, 12 it is guided by rails 18, 20 to a pair of gathering rolls 22, 24, which advances the corrugated strip toward a spring pressure plate 26. Pressure plate 26 cooperates with rail 18 to frictionally retard the advancing movement of the corrugated strip so that it is gathered or compressed lengthwise (by further bending at the crests of the convolutions) into its finished form as shown in 28.

Insofar as the apparatus illustrated in FIG. 1 is concerned, the present invention has to do with the design and configuration of form rolls 10, 12 and the shape of the fins or convolutions of the corrugated strip.

In conventional apparatus of the type illustrated in FIG. 1, the crests of successive convolutions or fins extend transversely of the strip in a straight line. The shape of the fins or convolutions in accordance with the present invention is serpentine or zig-zag in a transverse direction. This is best illustrated in FIGS. 2, 3 and 5, which show one section 30 of a corrugated heat exchanger strip according to the present invention. The section 30 includes two adjacent fins or walls 32, 34 connected at their upper ends by a return bend portion 36. The lower ends of these fins are connected to the next adjacent fins by similar bend portions 36. As is clearly shown in FIGS. 3 and 5, fins 32, 34 are of generally S-shape, as viewed in plan. With the strip being fed in a direction from left to right the forwardmost portions of fin 34, designated 38, can be considered as the crests of the transversely extending curvature. The rearwardmost portions of wall 34, designated 40, can be considered the roots of the transversely extending curvature. Since fins 32, 34 are spaced apart in parallel relation, the crests 42 and roots 44 of the next adjacent fin 32 are aligned in a lengthwise direction with the crests 38 and roots 40, respectively, of fin 34. It will be observed from FIGS. 3 and 5 that the degree of curvature of these walls or fins and the spacing therebetween, that is, the width of the return bends 36, are such that the crests 38 of fin 34 are aligned in a direction transversely of the strip with the roots 44 of fin 32. In other words, a straight transverse line 46 can be extended directly through the crests 38 and the roots 44 of successive fins. The next successive convolution has the same shape and relationship as illustrated in FIGS. 3 and 5. This is an important feature of the present invention since the provision of the straight line 46 provides a bend line about which the successive fins may be formed and bent to impart the sinuous configuration to the fins in a transverse direction while being roll formed.

Figure 10:
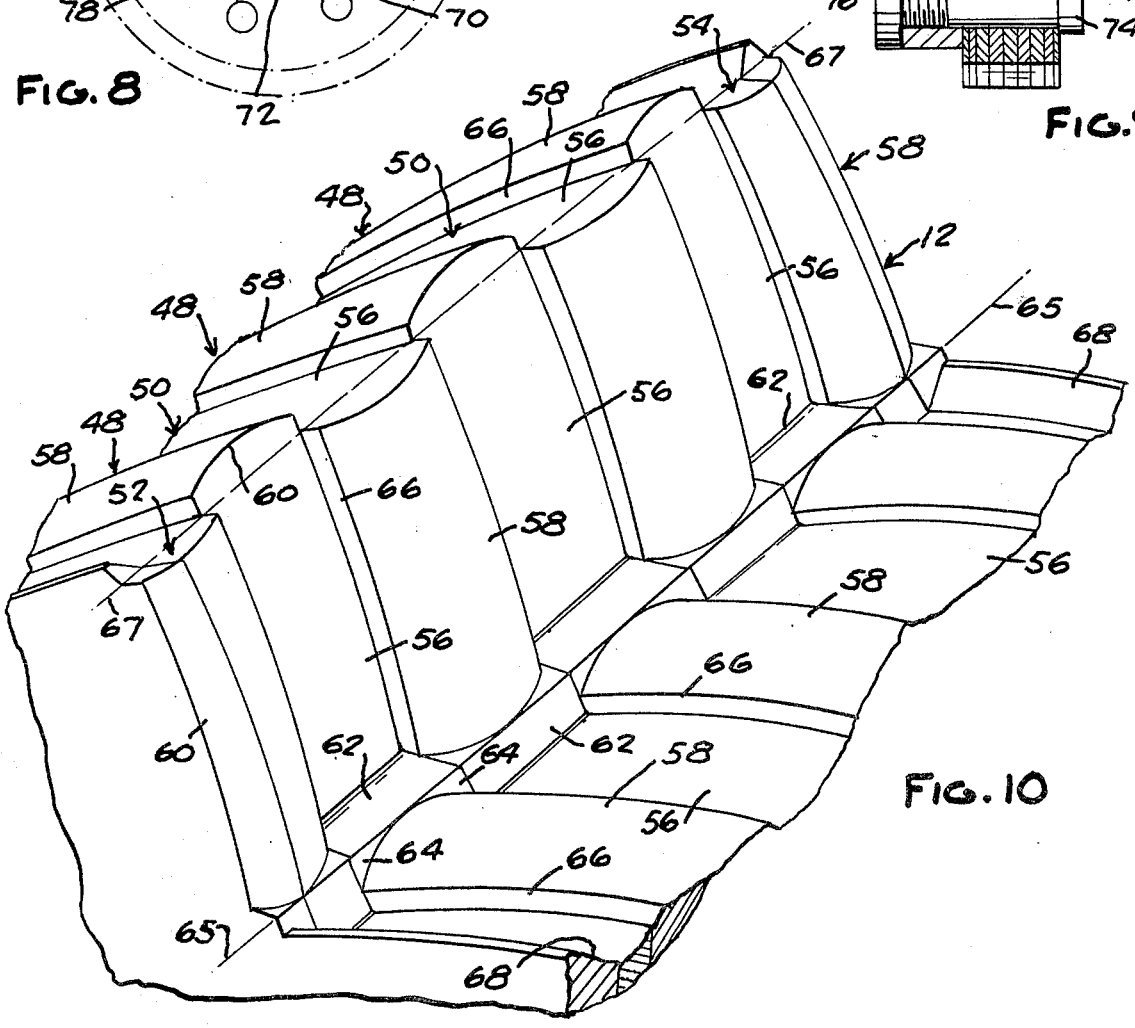
FIG. 10 is an enlarged fragmentary perspective view of one of the form rolls.

Referring now to FIG. 10, a portion of one of the form rolls is illustrated. Both form rolls are of identical construction and include a plurality of axially stacked segments. In the arrangement illustrated in FIG. 10, the segments 48 and the segments 50 are formed to exactly the same configuration, but are positioned reversely relative to one another when assembled. This is also true of segments 52, 54 and the opposite end segments 56, 58. Thus, the arrangement shown in FIG. 10 includes 3 differently shaped sets of segments which are alternately stacked axially adjacent in positions reversed with respect to one another. Each of the segments 48, 50 is formed with a plurality of generally triangular shaped teeth around its periphery. One face 56 of each tooth is generally flat in axial section and the opposite face 58 of each tooth is curved in axial section to correspond with the curvature of the fins illustrated in FIGS. 3 and 5. The crest 60 of each tooth is defined by the intersection of the flat face 56 and the curved face 58. If we consider the roll illustrated in FIG. 10 as the lower roll 12 which rotates in a clockwise direction, then the flat face 56 of the segments 48 can be considered as the leading face of the tooth and the curved face 58 as the trailing face of the tooth. Since rolls 10, 12 mesh in the manner of gears to form the strip 14 therebetween, it will be appreciated that in a radial plane the faces 56, 58 are slightly curved to generate an involute.

At the roots of the teeth the flat faces 56 terminate in shoulders 62 which are generally perpendicular to the flat face 56. Likewise at their radially inner ends the curved surfaces 58 terminate in shoulders 64 extending around opposite sides thereof. However the crest of each curved surface 56 at its radially inner end is flush with the plane of the adjacent shoulder 62. Shoulders 62, 64 intersect in a straight line 65 parallel to the axis of the roll at the root between successive teeth. A further radially extending shoulder 66 is located along the junctions of flat faces 56 and curved faces 58. Adjacent the crests of the teeth the flat faces 56 define an axially extending V-shaped groove, the apex of which is defined by a straight line 67.

Segments 52, 54 have a configuration generally similar to segments 48, 50 but are of narrower width. The two end segments 58 have similarly curved surfaces 66 at one side of each tooth and generally flat but inclined surfaces 68 at the other side of each tooth. In relation to the fin section shown in FIG. 3, the width of each shoulder 62 is approximately one-half the width of the return bend portion 36 which interconnects the successive fins at the upper and lower edges thereof. Referring to FIG. 10, it will be noted that the curved leading faces 58 of segments 50 present a convex configuration and the flat leading faces 56 of segments 48 are recessed and present a concave configuration. The upper roll 10 would be of identical construction as that shown in FIG. 10 and arranged to mesh therewith so that the curved trailing faces 58 of the teeth thereon would interengage with the flat faces 56 of segments 48 on roll 12 and the flat trailing faces 56 of the teeth on roll 10 would interengage with the curved faces 58 of segments 50 on roll 12.

In order to eliminate the tendency for the ribbon stock to drift laterally as it progresses through the form rolls, it is desirable to form the corrugated strip so that it is symmetrical about its longitudinal centerline. The end segments 52, 56 and 54, 58, are thinner than the remaining segments in order to preserve this symmetry in a strip of predetermined width. However, these end segments and the leading and trailing faces thereof function in the same manner as segments 48, 50.

Figure 8:
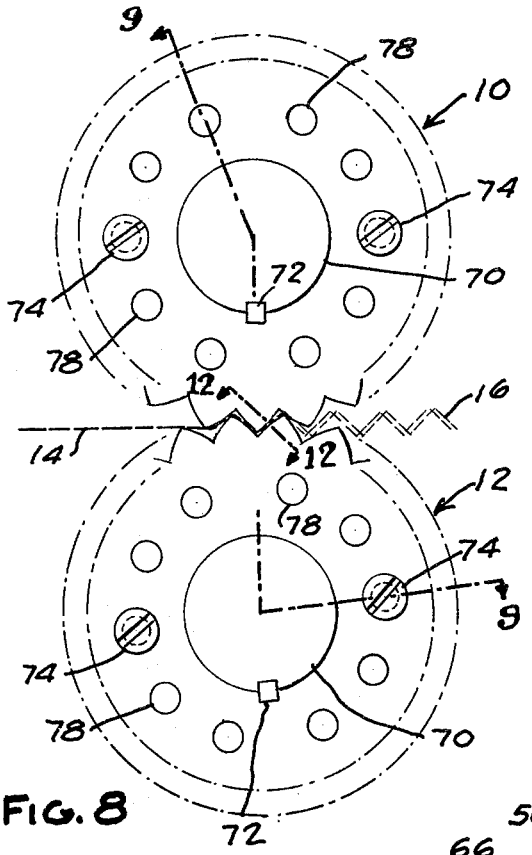
FIG. 8 is a side elevational view of a pair of form rolls according to the present invention.
Figure 9:
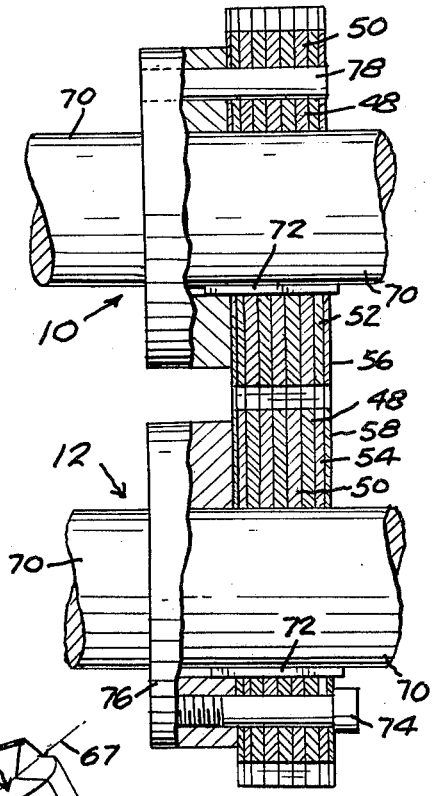
FIG. 9 is a sectional view along line 9—9 in FIG. 8.
Figure 11:
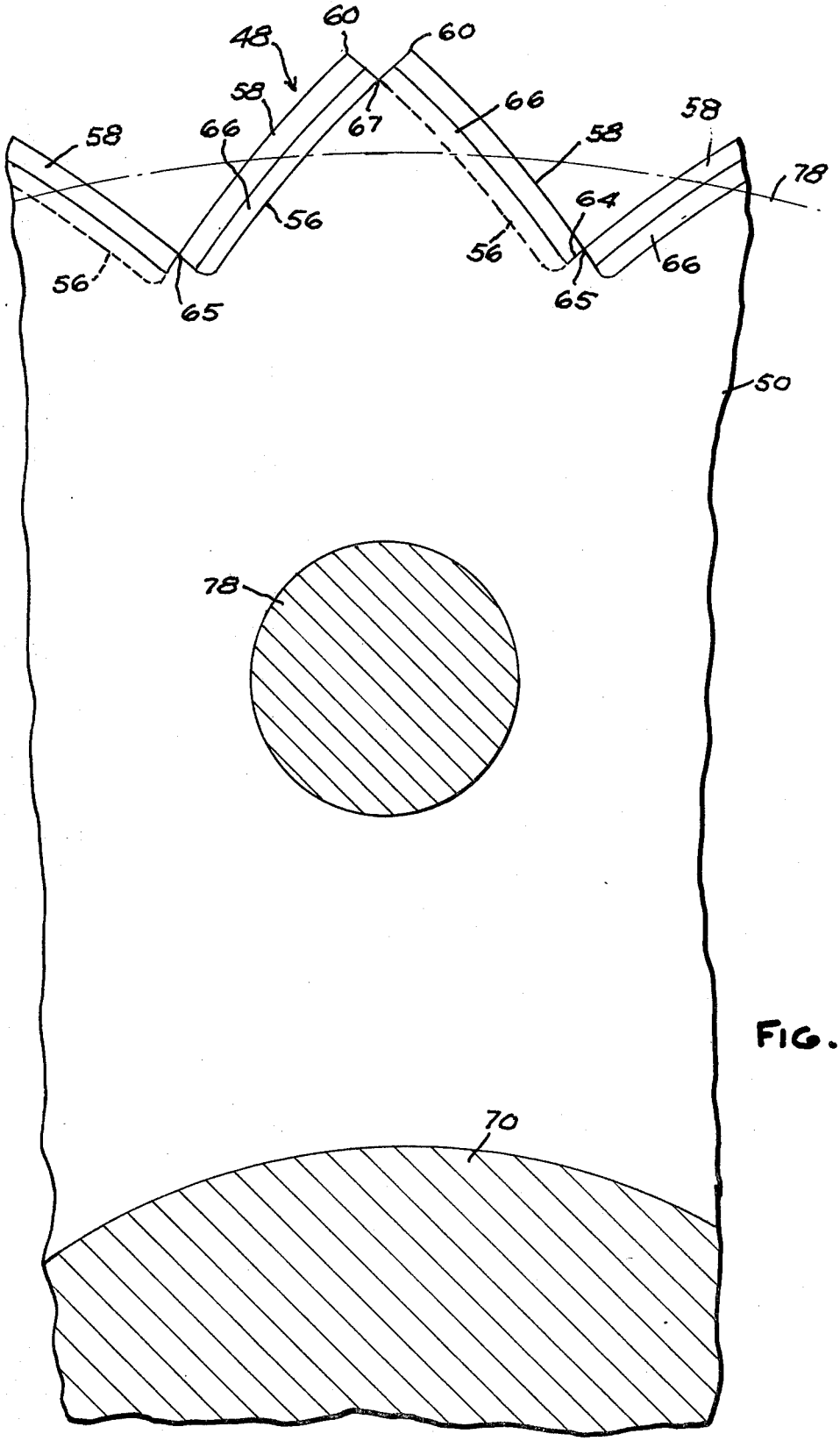
FIG. 11 is a fragmentary side elevational view, on an enlarged scale, of one of the form rolls.

Reference is now made to FIG. 11 which shows a pair of axially stacked segments 48, 50. In the showing of FIG. 11 a segment 50 is shown in the plane of the drawing and segment 48 is behind it. These segments as also shown in FIGS. 8 and 9 are mounted on a central shaft 70 to which they are keyed as at 72. They are retained in closely stacked relation by screws 74 extending through each of the segments and threaded into collars 76. Accurate relative positioning of the successive segments is obtained by means of dowel pins 78 extending through the segments.

Figure 12:
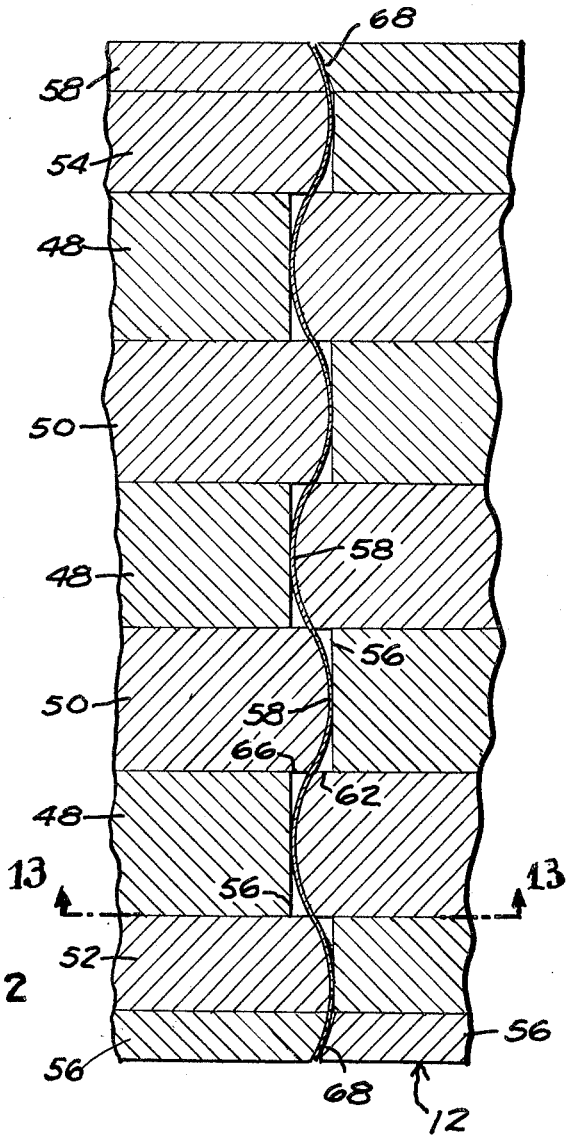
FIG. 12 is a sectional view along line 12—12 in FIG. 8.
Figure 13:
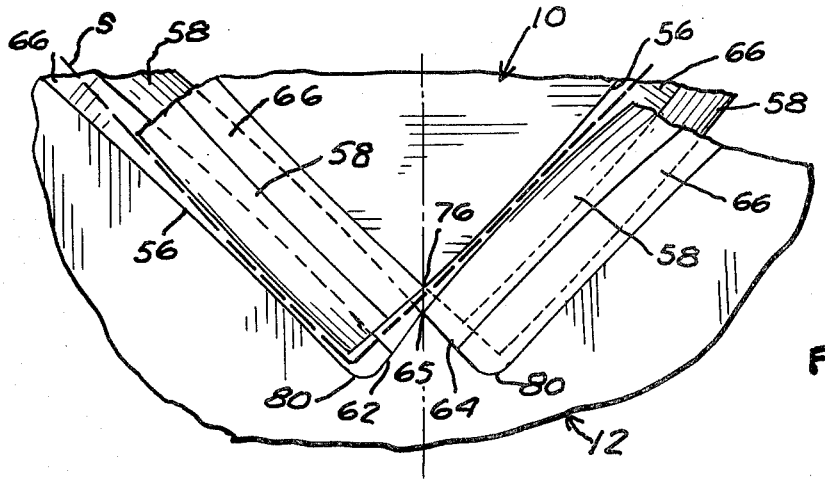
FIG. 13 is a sectional view along line 13—13 in FIG. 12.

Since FIG. 11 shows a segment 50 in the plane of the drawing and a segment 48 is shown behind it, the leading curved face 58 of each tooth is shown in solid lines and the flat trailing face 56 is also shown in solid lines. The flat leading face 56 of each tooth on segment 48 is shown in broken lines and the curved trailing face 58 on each tooth of segment 48 appears in solid lines. The pitch line of the teeth is designated 78. The manner in which the meshing teeth on the two rolls cooperate to impart the transversely sinuous configuration to each fin is clearly illustrated in FIG. 12. It will be noted that the ribbon stock is formed around the convexly curved faces 58 and into the concavities formed by flat faces 56 and shoulders 66. FIG. 13 illustrates specifically the manner in which the teeth of the two rolls mesh in the area generally adjacent the roots of the teeth on the lower roll 12. In FIG. 13 the strip stock being corrugated is designated by the broken line S. This view illustrates how a pair of adjacent fins and the return bends are formed on opposite sides of the centerline defined by the points 65, 67. It also shows that the shape of return bent portions 36 as roll formed is determined by the shape of the tooth crests. Since, as pointed out previously, the teeth are of involute contour, the inner ends of shoulders 62 are formed as radii 80 to permit the intermeshing rolling action of the two sets of teeth.

As the strip emerges from rolls 10 and 12, the adjacent fins are disposed at a relatively wide angle relative to one another as shown at O in FIG. 6. In view of the configuration of the adjacent sections, the return bent portion 36 (FIGS. 2 and 3) between successive transverse bends is V-shaped, as clearly illustrated at V in FIG. 6. The apex of this V coincides with the bend line 46 in FIG. 3. Thus in the strip section 30 illustrated, the convex or forwardly facing portions of wall or fin 32 adjacent the curve crests 42 are formed between the leading curved faces 58 on lower roll 12 and the trailing flat faces 56 on upper roll 10. The reversedly curved portions of wall 32 adjacent the roots 44 are formed between the leading flat faces 56 on upper roll 10 and the curved trailing faces 58 on lower roll 12. Thus as illustrated in FIG. 3 one-half of the return bend portions 36 lie on one side of the bend line 46 and the other half of the return bend portions 36 lie on the opposite side of bend line 46. Therefore, when forward movement of the corrugated strip is retarded by pressure plate 26, the adjacent fins are gathered and bent closer together at their upper and lower crests so as to flatten the V shown in FIG. 6 to the configuration shown in FIG. 4. All of the return bend portions 36 are substantially flat when the adjacent fins are sufficiently compressed to assume a generally parallel relation. As viewed from one side edge the finished strip will have the configuration illustrated in FIG. 7 and each of the return bend portions at the upper and lower ends of the convolutions will have formed therein a clearly perceptible bend line 46.

FIGS. 14–18 show a corrugated strip of slightly modified configuration and a portion of the rolls utilized for forming the same. The corrugated strip illustrated in these figures is generally designated 84 and differs from that illustrated in FIGS. 2 and 3 in that the zig-zag curvature of adjacent fins 32*a* and 32*b* is defined not by gradually curved surfaces but by relatively straight sections 86, 88 connected by vertically extending rounded corners 89. In other respects the strip 84 is the same as the strip section 30 illustrated in FIGS. 2 and 3. The rolls forming strip 84 differ from the roll shown in FIG. 10 substantially only in that the alternate teeth are formed with V-shaped surfaces 90 instead of the curved surfaces 58. The flat surfaces 92 of the rolls shown in FIG. 15 correspond to the flat surfaces 56 on the roll segments shown in FIG. 10. In other respects the rolls illustrated in FIG. 15 are the same as that illustrated in FIG. 10. FIG. 14 illustrates the corrugated strip as it emerges from the rolls illustrated in FIG. 15. As in the previously described embodiment the crests of the adjacent fins have a V-shape 94 imparted thereto. However after the corrugated strip is compressed or gathered at the pressure plate 26, the fins 96 assume the flattened zig-zag configuration shown in FIG. 17. Since strip 84 is formed in substantially the same manner as previously described, the return bend portions 98 connecting the upper and lower ends of adjacent fins are formed with a definite bend line 100 therein in the same manner and with the same function as bend line 46 in the embodiment illustrated in FIG. 3.

FIGS. 19–27 show further modified configurations of the crests of the successive convolutions of the strip. In the embodiments illustrated in these figures the transverse configuration of the strip can be either of curved zig-zag shape as shown in FIG. 3 or of flat zig-zag shape as shown in FIGS. 16 and 18. If it is desired to form the crests of the convolutions with substantially flat inclined return bend portions 102 as shown in FIG. 21, then the crests of the convex surfaces of the teeth of the roll segments are shaped as illustrated in FIG. 19. As is readily apparent by comparison of FIGS. 11 and 19, the V-shape groove 104 at the crests of the teeth shown in FIG. 19 is substantially wider and flatter than the corresponding groove shown in FIG. 11. The configuration of the roots of the teeth may be the same as shown in FIGS. 10 and 11 since the shape of the return bend portions 104 is determined primarily by the shape of the tooth crests. Thus as the corrugated strip emerges from form rolls having the configuration shown in FIG. 19, the strip has imparted to it the configuration shown in longitudinal section in FIG. 20. Thereafter when the strip is gathered or compressed lengthwise the fins are bent about the bend lines 106 to the configuration shown in FIG. 21. It will be appreciated that the fin or wall 108 of the transverse passageway through the strip is disposed at one side of bend line 106 while the adjacent fin or wall 110 lies on the opposite side of bend line 106.

FIG. 22 shows a manner in which the crests of the tooth segments on the two rolls may be modified to produce the cross sectional configuration of the return bend portions of the strip shown in FIG. 24. In this case the crests of the convex surfaces of the teeth are rounded as indicated at 112 so that as the strip emerges from the rolls it assumes the configuration illustrated in FIG. 23. Since the rolls illustrated in FIG. 22 are in all other respects the same as that illustrated in FIG. 10, a bend line 114 will be formed at each crest of the successive convolutions. Thereafter when the strip is gathered lengthwise, the adjacent fins will be bent around the bend lines 114 so that the finished cross section of the strip will correspond to the showing in FIG. 24.

If it is desired to form the return bend connections between adjacent fins with a rounded configuration of larger radius, then the crests of the convex surfaces of the teeth on the roll segments are formed to the shape shown in FIG. 25. More specifically the crests of the leading and trailing faces of adjacent teeth are formed with radii 116 which converge inwardly and downwardly in an axially extending straight line 118 which corresponds to the straight line 67 illustrated in FIG. 10. As the strip emerges from the form rolls illustrated in FIG. 25, it assumes the configuration shown in FIG. 26, wherein a straight bend line 120 extends transversely across the strip at each of the return bend portions. Thereafter when the strip is gathered lengthwise the adjacent fins 122, 124 will bend around the bend lines 120 so that the strip assumes the cross sectional shape illustrated in FIG. 27. As is true of the previous embodiments described the adjacent fins 122, 124 lie on opposite sides of the bend lines 20.

In the various embodiments of corrugated strips shown and described herein, in the finished form the adjacent fins are disposed in parallel relation. It will be appreciated that depending upon the extent to which the strip is gathered or compressed lengthwise by any suitable means such as pressure plate 26, the zig-zag, transversely extending passageways defined by the successive fins can have cross sectional shapes of smaller or larger area. For example in the arrangement shown in FIG. 7, if the strip is gathered to a greater extent, the adjacent bend portions at the upper and lower crests of the convolutions will be spaced closer together and each of the zig-zag passageways would be of smaller cross sectional area of generally triangular shape. If the strip is gathered to a much lesser extent than the cross section of the transversely extending passageways would be enlarged and of generally triangular shape.

It will be appreciated that in accordance with the present invention, the maximum curvature or offset of the zig-zag transverse contour of the passageways must be such that the straight bend lines, designated 46 in FIG. 3 and 100 in FIG. 16, cannot intersect the roots and crests of the transversely adjacent passageway sections. Referring to FIG. 3, for example, the straight bend line 46 cannot lie to the left of the crests 38 nor to the right of roots 44. On the other hand, if the straight bend line 46 is spaced to the right of the crests 38 and to the left of roots 44, a less turbulent fluid flow will occur through the passageway, since the extent of offset will be less. In any event, however, the two fins 32 and 34 must be symmetrical about the straight bend lines 46.

It will be further appreciated that the invention may be employed in forming heat exchanger fin stock wherein the passageways are straight, as distinguished from zig-zag in a direction transversely of the strip. In this event the two side walls 32, 34 would be flat throughout their transverse extent and the tooth faces of the rolls for forming the same would likewise be flat in an axial direction. Each tooth face would terminate in a shoulder 62 at the laterally inner end thereof. The tooth faces would define a V-shaped groove at the crest of each tooth. The cross sectional shape of each passageway would be the same as shown in FIG. 4 where it will be noted that the straight bend line projects slightly in a direction inwardly of the passageway. This construction is preferred over the conventional rolling method employed for straight fins because in the latter method when the strip is gathered, the return bent portions along the upper and lower edges of the convolutions tend to bulge outwardly, such bulges frequently present problems in connection with soldering of the coolant tubes on the return bent portions. With the present invention these outward bulges on the bent portions are avoided, since in the step of gathering the corrugated strip, the bending occurs along the sharp straight line 46,100.

I claim:

1. A strip of metal fin stock for use in heat exchangers comprising a metal strip having a series of longitudinally successive convolutions therein which extend transversely of the strip, each convolution being connected at the upper and lower edges thereof with the next adjacent convolutions on opposite sides thereof by return bent portions to define a plurality of passageways extending transversely of the strip, the two convolutions defining each passageway having a plurality of successive bends therein as viewed in horizontal section such that said transversely extending passageways each comprise a series of successive sections oriented in zig-zag fashion, said successive sections of each passageway being disposed symmetrically on opposite sides of a center line extending transversely of the strip at the return bent portions connecting them to convolutions defining each passageway, the crests of the alternate bends in one convolution of each passageway being aligned transversely along said center line with the roots of the other convolution of the passageway, whereby said center lines comprise straight bend lines about which each of the convolutions is bendable.

2. A strip of fin stock as called for in claim 1 wherein said successive bends are uniformly spaced across said strip.

3. A strip of fin stock as called for in claim 1 wherein each of said return bent portions is defined in part by a visually discernible line coinciding with said straight bent lines.

4. A strip of fin stock as called for in claim 3 wherein said return bent portions are generally flat and parallel to the plane of the strip.

5. A strip of fin stock as called for in claim 3 wherein said return bent portions are inclined to the vertical.

6. A strip of fin stock as called for in claim 5 wherein the return bent portions of successive passageway sections are inclined in opposite directions.

7. A strip of fin stock as called for in claim 6 wherein said inclined return bent portions are of arcuate contour when viewed transversely of the strip.

8. A strip of fin stock as called for in claim 3 wherein said zig-zag sections are defined by generally flat side walls.

9. A strip of fin stock as called for in claim 3 wherein said zig-zag sections are defined by generally arcuate side walls.

10. The method of making a heat exchanger fin stock which comprises directing a thin strip of metal between a pair of form rolls having intermeshing teeth around the periphery thereof, bending said strip between the meshing crests and roots of the teeth on the two form rolls alternately in opposite directions along regularly spaced transversely extending bend lines whereby to form said strip into a plurality of alternately inclined, longitudinally successive convolutions which are connected at their upper and lower ends with the next adjacent convolutions by return bent portions, simultaneously causing said teeth to bend said convolutions in a vertical direction throughout the vertical extent of the convolutions alternately in opposite directions so that each pair of adjacent convolutions defines a passageway extending transversely of the strip in zig-zag fashion, the successive vertical bends in each convolution being controlled in location and extent so that the crests of the vertical bends in one convolution are transversely aligned with the roots of the vertical bends in the next successive convolution and thereafter gathering said convolutions in a direction lengthwise of the strip to further bend the same at said transversely extending straight bend lines and thereby bring the successive return bent portions and the successive convolutions into more closely spaced relation.

11. The method called for in claim 10 wherein said vertical bends impart a curved configuration to said convolutions in horizontal section.

12. The method called for in claim 10 wherein said vertical bends define in horizontal section a series of generally straight zig-zag lines on each convolution.

13. The method called for in claim 10 wherein said return bent portions of successive sections of adjacent convolutions are initially formed by said rolls to generally V-shape.

14. The method called for in claim 13 wherein said step of gathering the convolutions causes the V-shaped return bent portions to flatten.

15. The method called for in claim 13 wherein said step of gathering the convolutions causes the return bent portions to be displaced into a plane generally parallel to the plane of the strip.

16. The method called for in claim 10 wherein said step of gathering the convolutions displaced them into generally parallel relation.

17. The method called for in claim 10 wherein said return bent portions are initially formed to generally V-shape and said step of gathering the convolutions inverts the V-shape contour of said return bent portions.

18. A pair of form rolls for producing heat exchanger fin stock from thin sheet metal strip, said rolls having generally triangularly shaped teeth around the outer periphery thereof which are arranged so that when the rolls are rotated in opposite directions the crests of the teeth on each roll mesh with the roots of the teeth on the other roll, each roll comprising a plurality of axially adjacent segments on which said teeth are formed so that the teeth in each roll are defined by a plurality of axially adjacent tooth sections, the contour of one roll segment being the reverse of the contour of the next adjacent segment so that the leading face of each tooth section corresponds in shape with the trailing face of the next axially adjacent tooth section, the lading face of axially alternate tooth sections being convex and the leading face of the other axially alternate tooth sections being concave, whereby both the leading and trailing faces of the teeth on each roll define undulating surfaces when viewed radially, the convex tooth sections of one roll being disposed to mesh with the concave tooth sections on the other roll when the rolls are rotated, the leading and trailing faces of circumferentially adjacent tooth sections terminating at their radially inner ends in shoulders which extend generally radially outwardly and towards each other and intersect in an axially extending straight line adjacent the root between successive teeth, said straight line being disposed radially outwardly of the radially inner ends of said tooth faces, the concave face portions of the leading and trailing faces of the tooth sections on each roll, when viewed axially, intersecting adjacent the crests thereof to define axially extending straight lines which when the rolls are rotated revolve into close proximity and radial alignment with said straight lines adjacent the roots between successive teeth on the other roll.

19. Form rolls as called for in claim 18 wherein the crests of the axially adjacent tooth sections define a generally V-shape groove when viewed axially, said line of intersection of said concave faces defining the apex of said groove.

20. Form rolls as called for in claim 18 wherein the convex tooth aces are generally V-shaped in a plane concentric to the axis of the roll.

21. Form rolls as called for in claim 18 wherein the convex tooth faces are of arcuate contour in plane concentric to the axis of the roll.

22. Form rolls as called for in claim 18 wherein the crests of the tooth sections of convex shape are arcuate when viewed axially.

23. Form rolls as called for in claim 18 wherein the circumferentially projecting crests of the convex face portions of successive teeth are aligned with the straight lines of intersections of said shoulders.

24. A pair of form rolls for producing heat exchanger fin stock from thin sheet metal strip, said rolls having generally triangularly shaped teeth around the outer periphery thereof, the successive teeth on the two rolls being of identical configuration and arranged so that, when the rolls are rotated in opposite directions, the crests of the teeth on each roll mesh with the roots between the teeth on the other roll, the crest of each triangularly shaped tooth having an axially extending, radially outwardly opening V-shape groove therein and the root between successive triangularly shaped teeth being defined by a pair of shoulders projecting generally radially outwardly from the opposed faces of circumferentially adjacent teeth to said shoulders and intersecting in a straight line extending axially through said root and spaced medially from said tooth faces, the apices of the V-shaped grooves at the crests of the teeth being adapted to revolve into close proximity and radial alignment with the said lines of intersection of said shoulders when the rolls are rotated, the radial extent of each tooth being at least several times the radial extent of said grooves and shoulders and the circumferential extent between the crests of successive teeth being at least several times the circumferential extent of the open end of each groove.

* * * * *